US010373594B1

(12) United States Patent
Doe et al.

(10) Patent No.: US 10,373,594 B1
(45) Date of Patent: Aug. 6, 2019

(54) HAND PAN TONGUE DRUM

(71) Applicants: Grahm Doe, Oakhurst, CA (US); David S. Beery, Lakewood, CA (US)

(72) Inventors: Grahm Doe, Oakhurst, CA (US); David S. Beery, Lakewood, CA (US)

( * ) Notice: Subject to any disclaimer, the term of this patent is extended or adjusted under 35 U.S.C. 154(b) by 151 days.

(21) Appl. No.: 14/120,628

(22) Filed: Jun. 11, 2014

(51) Int. Cl.
*G10D 13/02* (2006.01)

(52) U.S. Cl.
CPC ..... *G10D 13/02* (2013.01)

(58) Field of Classification Search
CPC .... G10D 13/02; G10D 13/028; G10D 13/021; G10D 13/027; G10D 13/00; G10D 13/022
USPC ..... 84/411 R
See application file for complete search history.

(56) References Cited

U.S. PATENT DOCUMENTS

| | | | | |
|---|---|---|---|---|
| 8,492,632 | B1 | 7/2013 | Doe | |
| 8,552,279 | B2 | 10/2013 | Rohner et al. | |
| 2004/0035283 | A1* | 2/2004 | King | 84/411 R |
| 2011/0162510 | A1* | 7/2011 | Copeland | 84/421 |

* cited by examiner

*Primary Examiner* — Kimberly R Lockett
(74) *Attorney, Agent, or Firm* — Richard A. Ryan

(57) ABSTRACT

Disclosed is a tuned steel hand pan tongue drum musical instrument. It is formed from joining together two thin walled steel contiguous arcuate domes. The top dome has a plurality of tuned steel drum tone fields located at various places around the periphery thereof, and a plurality of tongues cut into the steel in the upper portion of the dome. The tongues are tuned to match the fundamental frequency and/or harmonic of the different steel drum tone fields (SDTF). When struck with fingers, mallets, or other devices, the tongues emit a tuned tone and the vibration travels through the steel exciting the matched tone SDTF. The SDTF then begins resonating and produces a musical tone even though it was not touched. The reverse is also the case. When an SDTF is played, its vibration excites a similarly tuned tongue and causes it to resonate. The SDTR and the tuned tongue share the vibration and mutually benefit sonically from the effect created.

14 Claims, 10 Drawing Sheets

HAND PAN TONGUE DRUM

BACKGROUND OF THE INVENTION

1. Field of the Invention

The present invention relates to a tuned steel hand pan and tongue musical instrument, or drum, formed by joining two thin walled contiguous arcuate domes made of thin steel. The domes are affixed to each other at the respective mouths thereof. Thus the drum has an upper dome and a lower dome. The upper dome of the instrument contains a plurality of spaced apart tone fields situated in the lower portion of the dome around the periphery thereof, and a plurality of spaced apart tongues cut into the upper part of the dome near its apex. The lower dome, which is inverted and fastened to the upper dome at the mouth thereof, has a large orifice cut into the apex thereof, through which sound resonates.

2. Description of the Related Art

Steel tongue drum instruments are well known in the art. See, for example, the drums shown on the website, www.hapidrum.com and http://en.wikipedia.org/wiki/Steel_tongue_drum. One such steel tongue drum is claimed in U.S. Pat. No. 8,492,632, Doe, issued Jul. 23, 2013. It relates to a tuned bell harmonic musical instrument. The tuned bell instrument has a bell configuration with vertical walls connected by an arcuate dome. The dome has a plurality of tongues cut into it, which, when struck, generate specific musical notes, or tones. Thus, the steel tongue drum has the ability to create vibrations and add to bell tones. The contents of U.S. Pat. No. 8,492,632 are incorporated by reference herein in its entirety. U.S. Pat. D620,041 S, also discloses and claims a design for a steel tongue drum.

Steel Pans/Drums are also well known musical instruments. See, for example, the drums offered for sale on the web site, http://www.davesislandinstruments.com. A new variation of the steel pan musical instrument is the "Hand Pan", also known as "Hang". This steel pan instrument was created by Felix Rohner and Sabina Scharer of the PanArt company. See, for example http://en.wikipedia.org/wiki/Hang_drum. See also US Patent Application Publication 2012/0304845, published Dec. 6, 2012, Rohner, et. al., and U.S. Pat. No. 8,552,279, issued Oct. 8, 2013 Rohner, et. al.

DEFINITIONS

The following definitions are used in this application.

1. Sympathetic: Physics. Noting or pertaining to vibrations, sounds, etc., produced by a body as the direct result of similar vibrations in a different body.
2. Decay: The decrease in amplitude when a vibrating force has been removed. The actual time it takes for a sound to diminish to silence is the decay time. How gradually this sound diminishes is its rate of decay.
3. Attack: How quickly the sound reaches full volume after the sound is activated.
4. SDTF: Acronym for Steel Drum Tone Field.

BRIEF SUMMARY OF THE INVENTION

Disclosed is a tuned steel hand pan tongue drum instrument. It is formed from joining together two thin walled steel arcuate domes. The upper dome has a plurality of spaced apart steel drum tuned tone fields located around the periphery thereof, and a plurality of spaced apart tongues cut into the steel in the upper portion of the dome. The tongues are tuned to match the fundamental frequencies and/or the harmonic tones of the different steel drum tone fields (SDTF) spaced around the periphery of the dome. When struck with fingers, mallets, or other devices, the tongues emit a tuned tone and the vibration travels through the steel exciting the matched tone SDTF. The SDTF then begins sounding and produces a musical tone even though it was not touched. The reverse is also the case. When an SDTF is played, its vibration excites a similarly tuned tongue and causes it to resonate. The SDTF and the tuned tongue share the vibration and mutually benefit sonically from the effect. Those skilled in the practice of making steel drum instruments will understand it can have any number of tongues and SDTFs built in the drum as well as variations in the shape and or size of the instrument, yet fall within the purview of this invention.

It is therefore an object of this invention to provide a tuned steel hand pan tongue drum instrument that combines the virtues of the tuned bell harmonic musical instrument described in U.S. Pat. No. 8,492,632 with a hand pan instrument such as is described by Felix Rohner in various publications. The sound generated when the steel hand pan tongue drum instrument is struck is more pleasing to the ear, than the sound generated by either instrument individually.

DETAILED DESCRIPTION OF THE INVENTION

Figure 1:
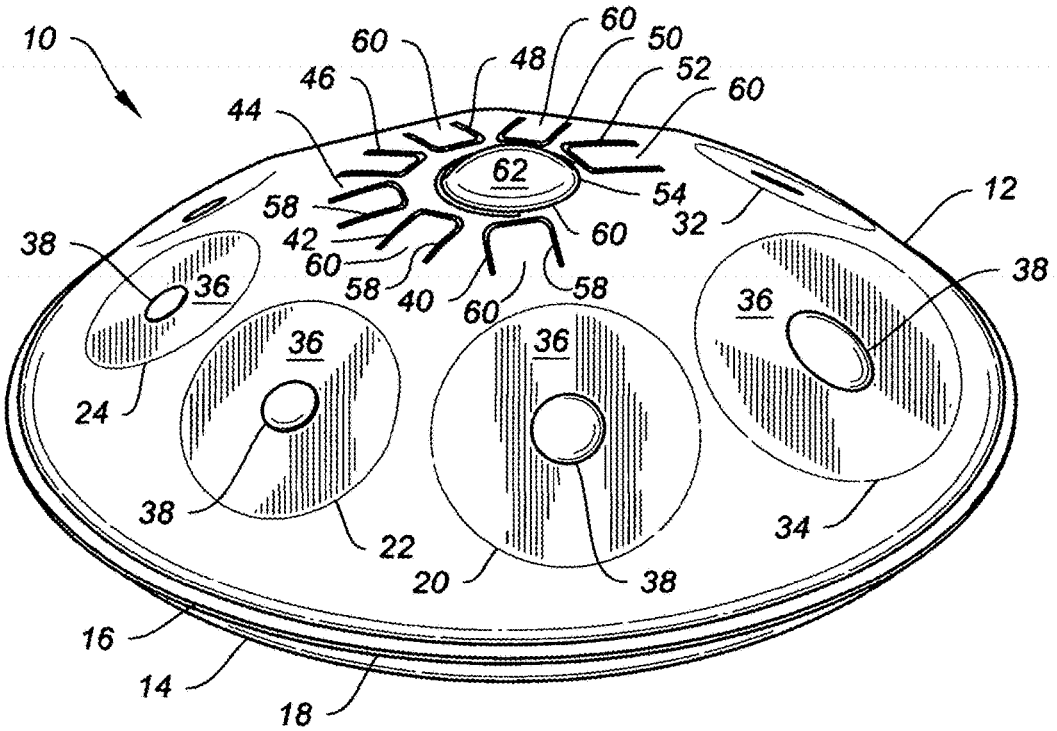
FIG. 1 is a perspective view of the tuned steel hand pan tongue instrument of this invention.

The hand pan tongue drum instrument of my invention, is best seen in FIGS. 1-8. The drum 10 comprises two domes, an arcuate upper dome 12 and an arcuate lower dome 14. The domes 12 and 14 are fixed to each other at their mouths 16, and 18, around the peripheries thereof. The lower dome 14 is inverted and joined to the upper dome 12. Preferably the two domes 12 and 14 are glued together with a metal bonding glue, but they could also be welded or clamped. It is important that the joints between the two domes be tightly sealed so as to prevent sound from escaping therefrom, and to add improved sound characteristics to the drum. A tight seal between the upper dome 12 and lower dome 14 is very important for optimal tone resonance. A tight seal between the two domes allows vibrations to resonate in a pure, controlled form within the body of the instrument. If the seal is soft or inconsistent, the tone vibrations dither out and reduce the overall resonance of the drum.

Figure 8:
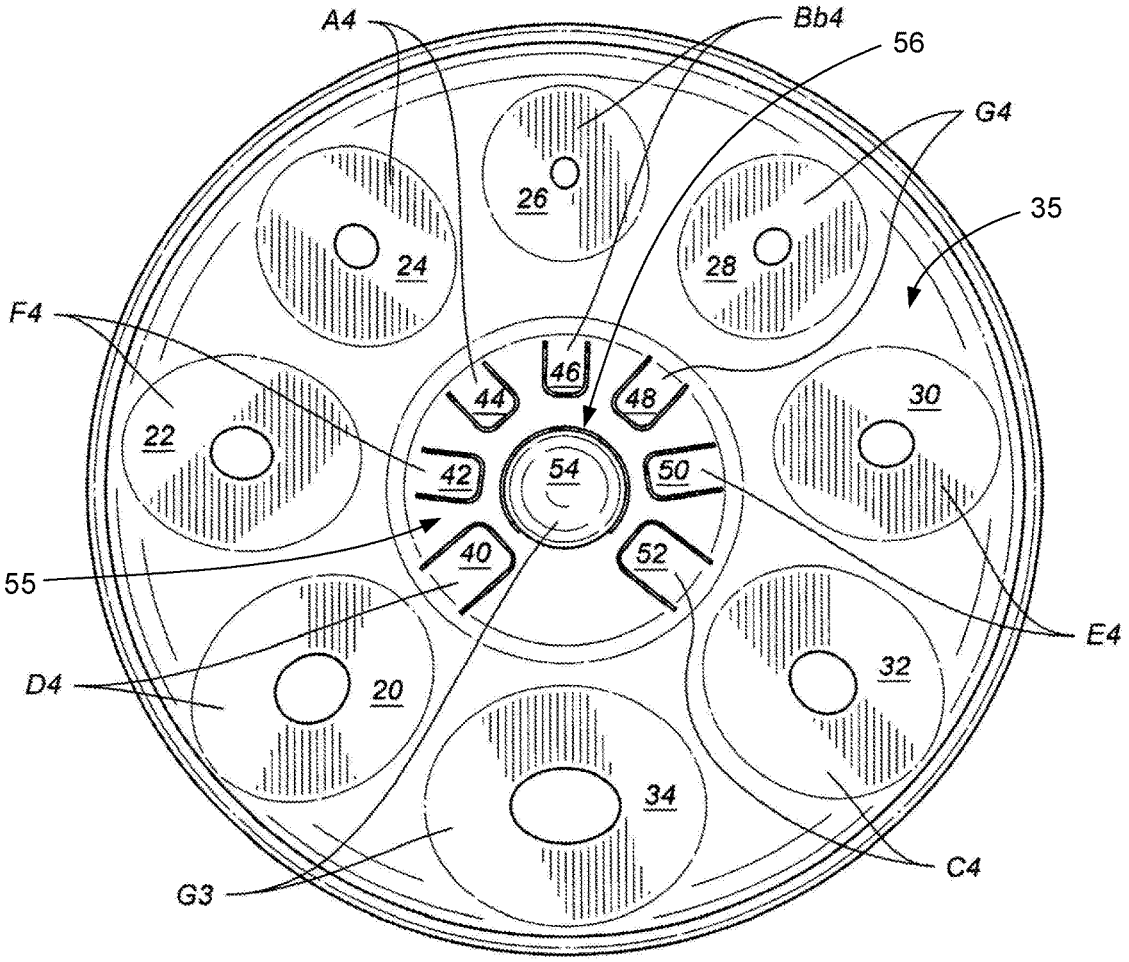
FIG. 8 is an enlarged plan view of the top dome of the drum of my invention showing the correlation between sounds generated by field tones (SDTF), and tongues.

The upper dome 12 contains a plurality of tone fields, numbered 20 through 34 herein, situated at spaced apart intervals in the lower outer surface 35 of the dome 12, as shown in FIG. 8. Each tone field 20 through 34 comprises a flattened area 36 on the upper dome 12 having a generally circular configuration. A dimple 38 is situated in the center of each flattened area 36. The dimples 38 are circular in configuration and extend inwardly into the upper dome 12 a short distance (i.e., about a centimeter). The dimensions of the flattened area 36 of each tone field 20 through 34, and the associated dimples 38, will vary in accordance with the specific note that one intends to generate.

Each tone field 20 through 34 generates a unique, specific sound when struck, i.e., a musical note.

A plurality of tongues 40 through 54 are cut into the upper outer surface 55 of the upper dome 12 surrounding the apex 56 thereof. Tongues 40 through 52 are rectangular in dimension, while tongue 54 is semi circular. Each tongue 40 through 52 is of a specific unique dimension and is formed by cutting a U-shaped slot 58 into the upper outer surface 55 of the upper dome 12, as shown in FIG. 8, so as to define a rectangular tongue therein. The base 60 of each tongue 40 through 52 is continuous with the rest of the upper outer surface of the upper dome 12. Each tongue 40 through 52 is of a different square area than the others in the upper dome 12, and generates a different tone or musical note when struck with a mallet, or finger, or other instrumentality. Tongue 54 is different from tongues 40-52 in that it is semi-circular in area and is formed by cutting a semi-circular slot 60 in the upper surface 55 of the upper dome 12 at the apex 56 thereof.

In the preferred embodiment of the invention an arcuate minidome 62 is situated at the top of the dome 12. It projects upward from the apex 56 of the dome 12, and its function is to provide an easy shape to strike.

The lower dome 14 is a mirror image of the upper dome 12, except that it does not contain any tone fields, or tongues. Instead, an orifice 64 is cut into the apex 66, so as to allow sound to exit from the inside of the drum 10 when the drum is struck. In the preferred embodiment, the orifice 64 has a diameter of about 3.5 inches.

Figure 2:
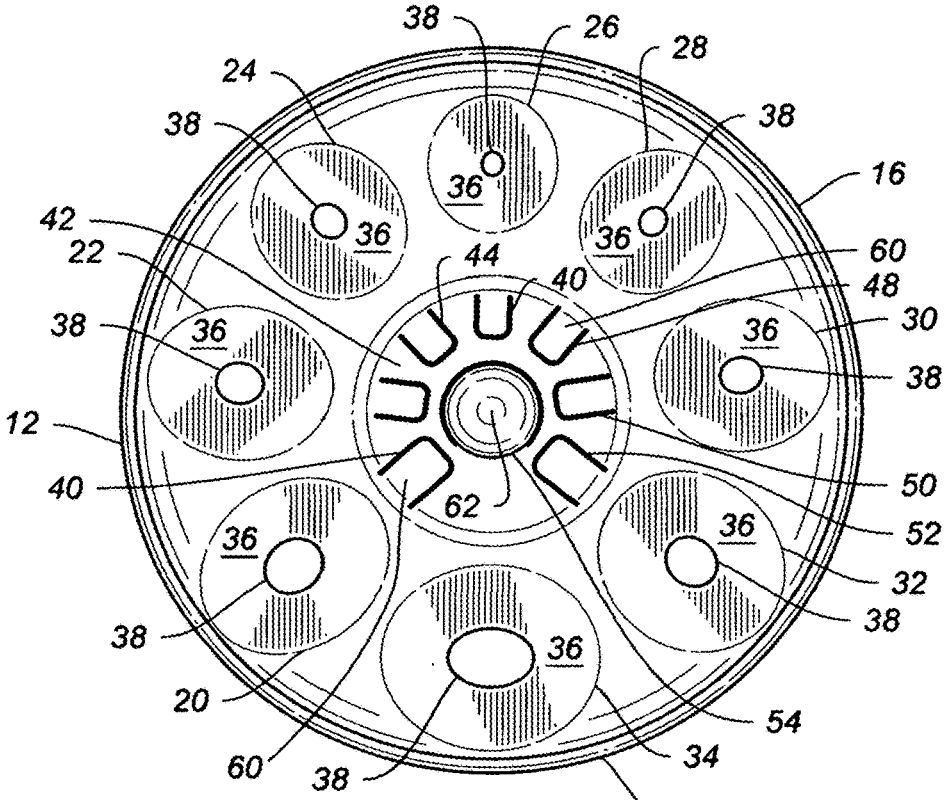
FIG. 2 is a top plan view thereof.
Figure 3:
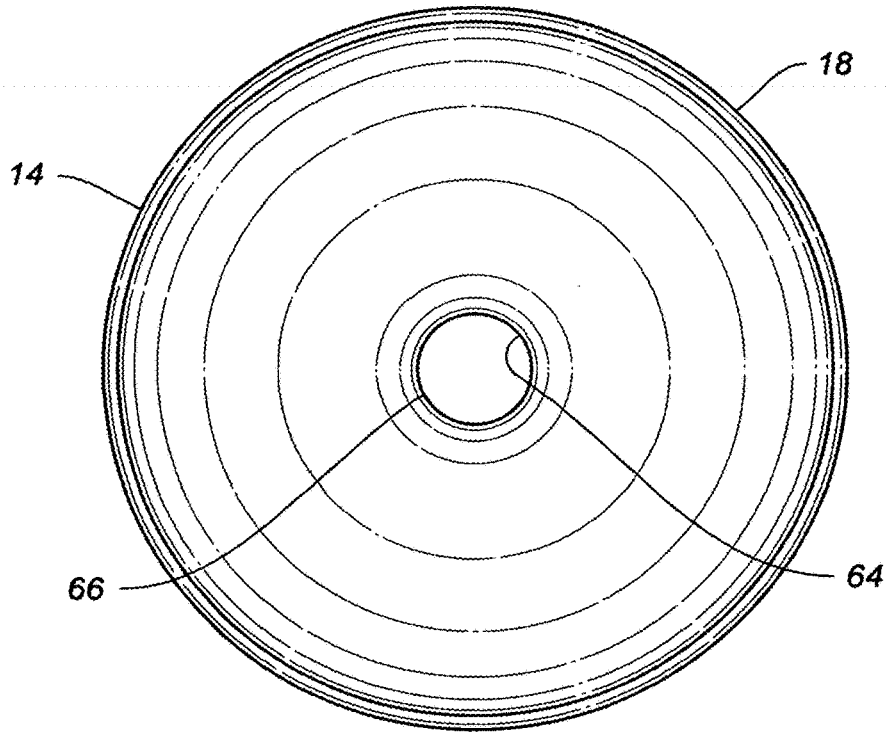
FIG. 3 is a bottom plan view thereof.
Figure 4:
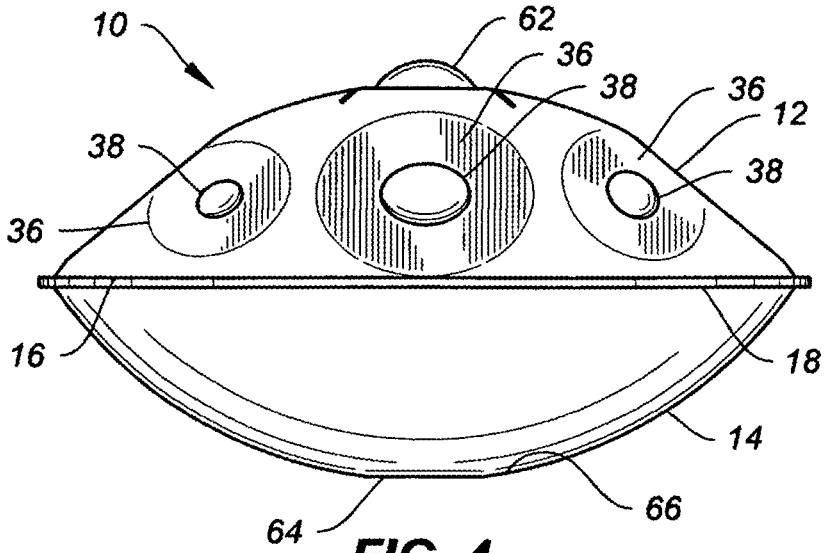
FIG. 4 is an elevational view of the front thereof.
Figure 5:
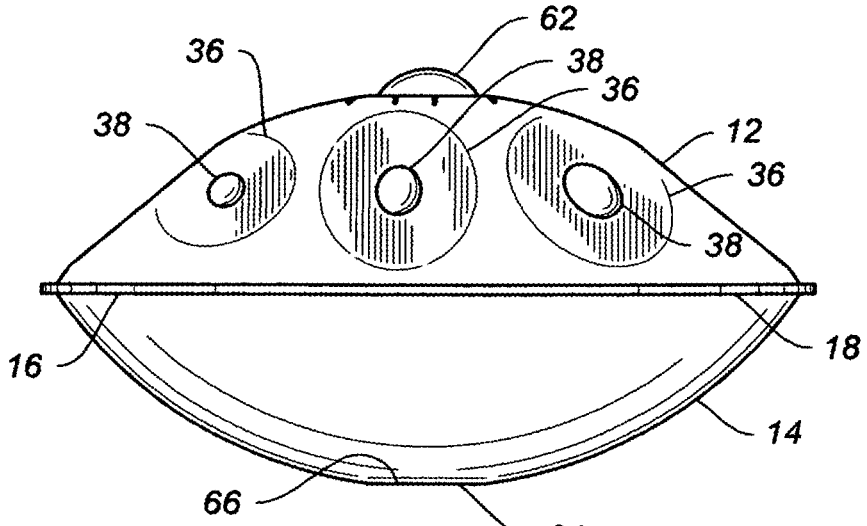
FIG. 5 is an elevational view of the back thereof.
Figure 6:
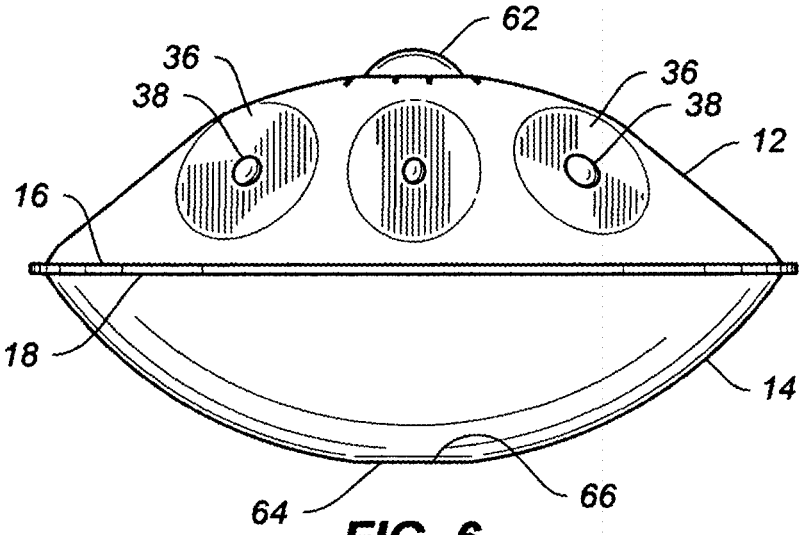
FIG. 6 is an elevational view of one side thereof.
Figure 7:
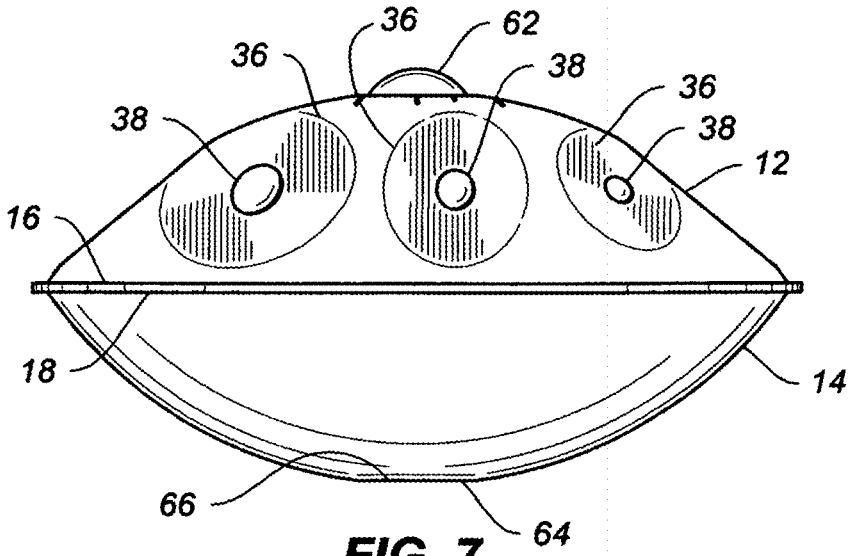
FIG. 7 is an elevational view of the opposite side thereof.

The drum of my invention can be made in many different sizes. In the preferred embodiment, however, each dome 12 and 14 is about 20 inches in diameter, and the height of each dome 12 and 14 from the mouth to the apex thereof, is about 4 inches. As best seen in FIGS. 2 and 8, the upper dome 12 has 8 tone fields, 20-34, situated around the periphery thereof, and there are a corresponding number of tongues 40-54 cut into the upper portion thereof. Each tongue 40-54 is tuned to the same sound as a corresponding tone field 20-34. That is, tongue 40 is tuned to tone field 20, tongue 42 is tuned to tone field 22, and so forth. Thus, in the preferred embodiment of the invention, there are 8 tone fields, each generating a certain note when struck, and 8 tongues, each of which is tuned to a specific tone field, and generates the same note as its corresponding tone field. The tuning is done with a strobe tuner or similar sound frequency analyzer in accordance with normal practice by those skilled in the art. Additionally, each dimple 38 has a different surface area, and its size is determined by the sound desired from the tone field 20 through 34, when it is struck. Each flattened area 36 has a diameter ranging from about 5 to about 7 inches. The diameter of the dimples range from about 1 inch to 2 inches, depending on the particular tone field with which it is associated and a part thereof.

In the preferred embodiment of the invention, the upper dome 12 has 8 tongues 40-54 cut into it. Tongue 40 is about 4.5 cm by about 4.5 cm, having a surface area of about 20.2 square cm.; tongue 42 is about 3.2 cm by about 4.0 cm, having a surface area of 12.8 square cm.; tongue 44 is about 2.5 cm by about 4.0 cm. having a surface area of about 10 cm; tongue 46 is about 2.8 cm by 3.5 cm, having a surface area of about 9.8 square cm.; tongue 48 is about 2.5 cm by 3.5 cm, having a surface area of about 8.7 square cm.; tongue 50 is about 2.7 cm. by about 3.5 cm. having a surface area of about 10 cm; tongue 52 is about 2.5 cm by about 4.0 cm, having a surface area of 10 cm.; and semi-circular tongue 54 is 7 cm in diameter, and has a surface area of about 38.48 square cm.

Each tongue 40 through 54 will vibrate individually when struck. Each of the tongues 40 through 54 has a different surface area, thus producing different notes, when struck with fingers or a mallet. Tongue 40 produces a D note in the $4^{th}$ octave; tongue 42 produces an F note in the $4^{th}$ octave; tongue 44 produces an A note in the 4th octave; tongue 46 produces a B flat note in the $4^{th}$ octave; tongue 48 produces a G note in the $4^{th}$ octave; tongue 50 produces an E note in the 4th octave; tongue 52 produces a C note in the 4th octave; and tongue 54 produces a G note in the $3^{rd}$ octave.

Each of the tongues 40-54 are tuned to corresponding notes generated in tone fields 20, through 34. Thus tone field 20 generates a D note in the $4^{th}$ octave; tone field 22 generates an F note in the $4^{th}$ octave; tone field 24 generates an A note in the $4^{th}$ octave; tone field 26 generates an B flat note in the 4th octave; tone field 28 generates a G note in the 4th octave; tone field 30 generates an E note in the 4th octave; tone field 32 generates an C note in the $4^{th}$ octave; and tone field 34 generates a G note in the 3rd octave.

Each dome of the hand pan tongue drum 10 of my invention is made by preparing a mold, placing a thin sheet of steel on the mold, and stamping the dome in accordance with the shape of the mold. The drum is finished up by hand, utilizing hand tools, and/or power tools to create the specific tone fields, and tongues desired. A computer controlled cutter like a water jet can be used to cut the slots which define the tongues. Once each dome is completed, it is glued to the opposite dome to form the complete drum.

In the manufacturing process the tone fields 20-34 are first rough shaped with air hammers to flatten the surfaces of the dome 12, then the tongues 40-54 are rough cut. The tone fields 20-34 are then fine tuned to generate the desired notes, and the tongues 40-54 are fine tuned last. The tongues 40-54 are cut too short (higher pitch) to start with for the note ultimately desired. Then, the cuts defining the tongues 40-54 are carefully lengthened so as to drop the individual tones down until they match the notes generated by the respective tone fields 20-34. Each drum is a little unique where identical tongue cuts can produce slightly different pitches. So the tongues 40-54 are cut longer by hand until the perfect pitch is reached. In the preferred embodiment of my invention there are 8 tone fields, and 8 tongues, however, other combinations can be used. Thus, one can have a single tone field, and 8 tongues, one of which tongues resonates with the single tone field. Or, one could have 4 tone fields and 8 tongues. It is also possible to have tongues tuned to the harmonic tones of the STDF to create the same effect. What is important is that a specific tongue generating a note be tuned to a specific SDTF tone field generating the same note.

FIGS. 9-13 illustrate the effects obtained by utilizing sounds from the tongue 52 in connection with sounds generated from the tone field 32.

The sounds were analyzed by first picking up the sounds with a microphone, then transferring the sounds to a computer upon which sound analyzing software was installed.

The present invention uses the vibration effects of tuned steel tongues and tuned SDTFs (steel drum tone fields) to sympathetically excite matching pitches found on a hand pan or steel drum. This unique interaction was unexpectedly discovered when experimenting with adding tongues to a hand pan. It was found that if a steel tongue was tuned to the same note of a hand pan note, i.e. a note generated by a tone field, the vibration traveled through the steel and "found" the SDTF and made it sympathetically resonate creating a desirable effect.

Figure 9:
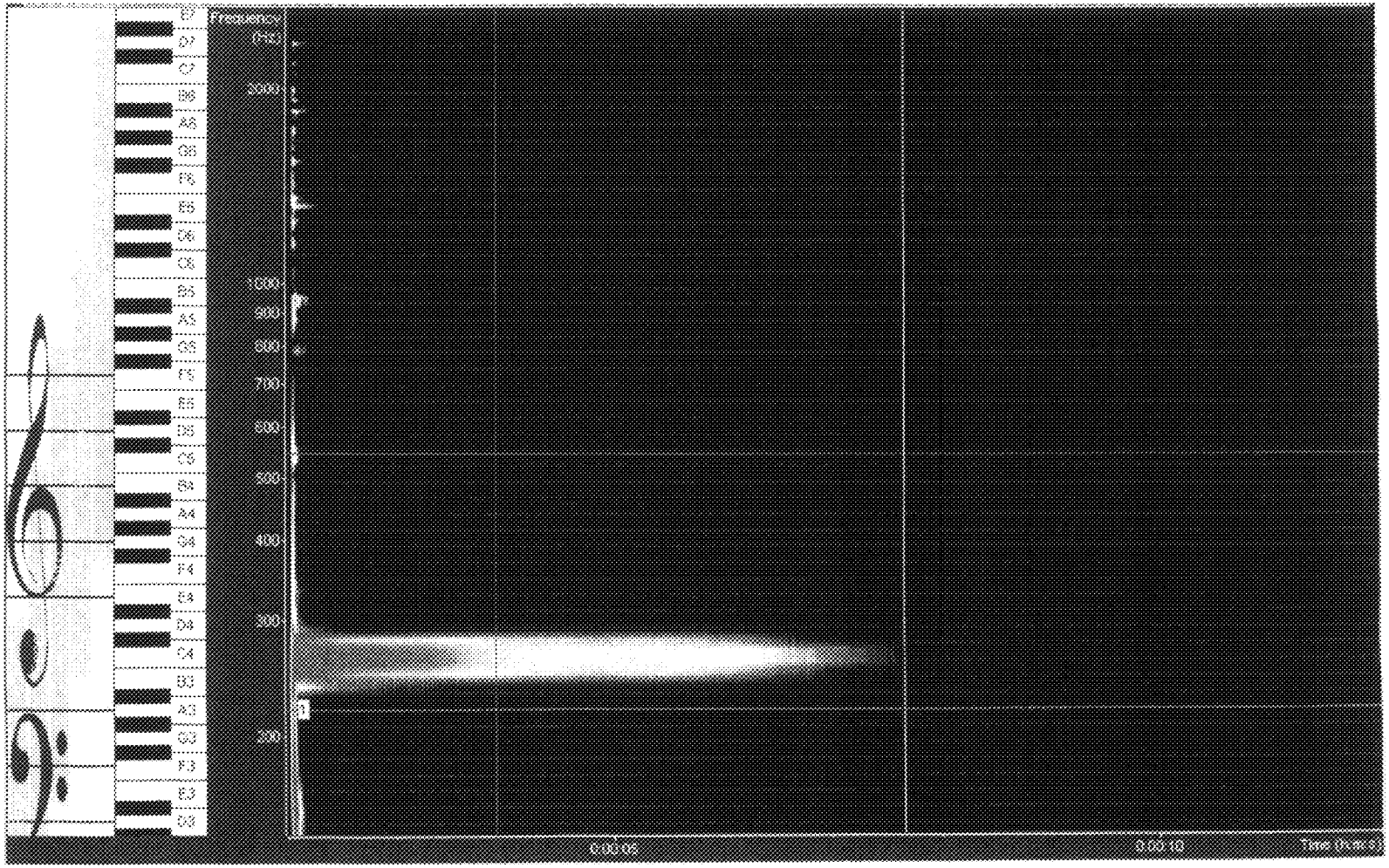
FIG. 9 is a print out of the sound generated when a tongue note tuned to C4 (the note C in the $4^{th}$ octave) is played by itself while muting all other notes on the instrument.
Figure 10:
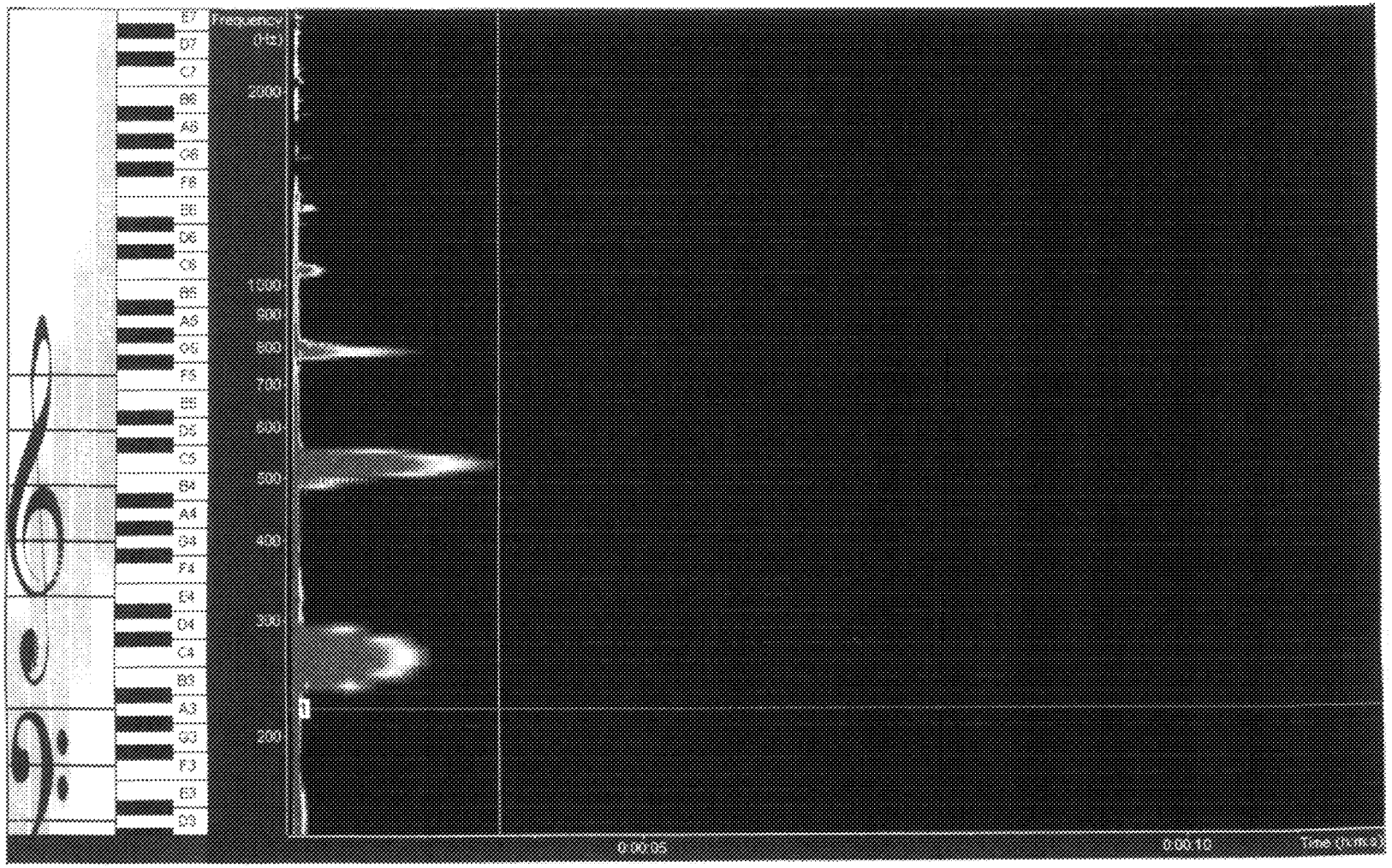
FIG. 10 is a print out of the sound generated when an SDTF tuned to C4 (with tuned overtones of C5, and G5 respectively) is played while muting all other notes on the instrument.
Figure 11:
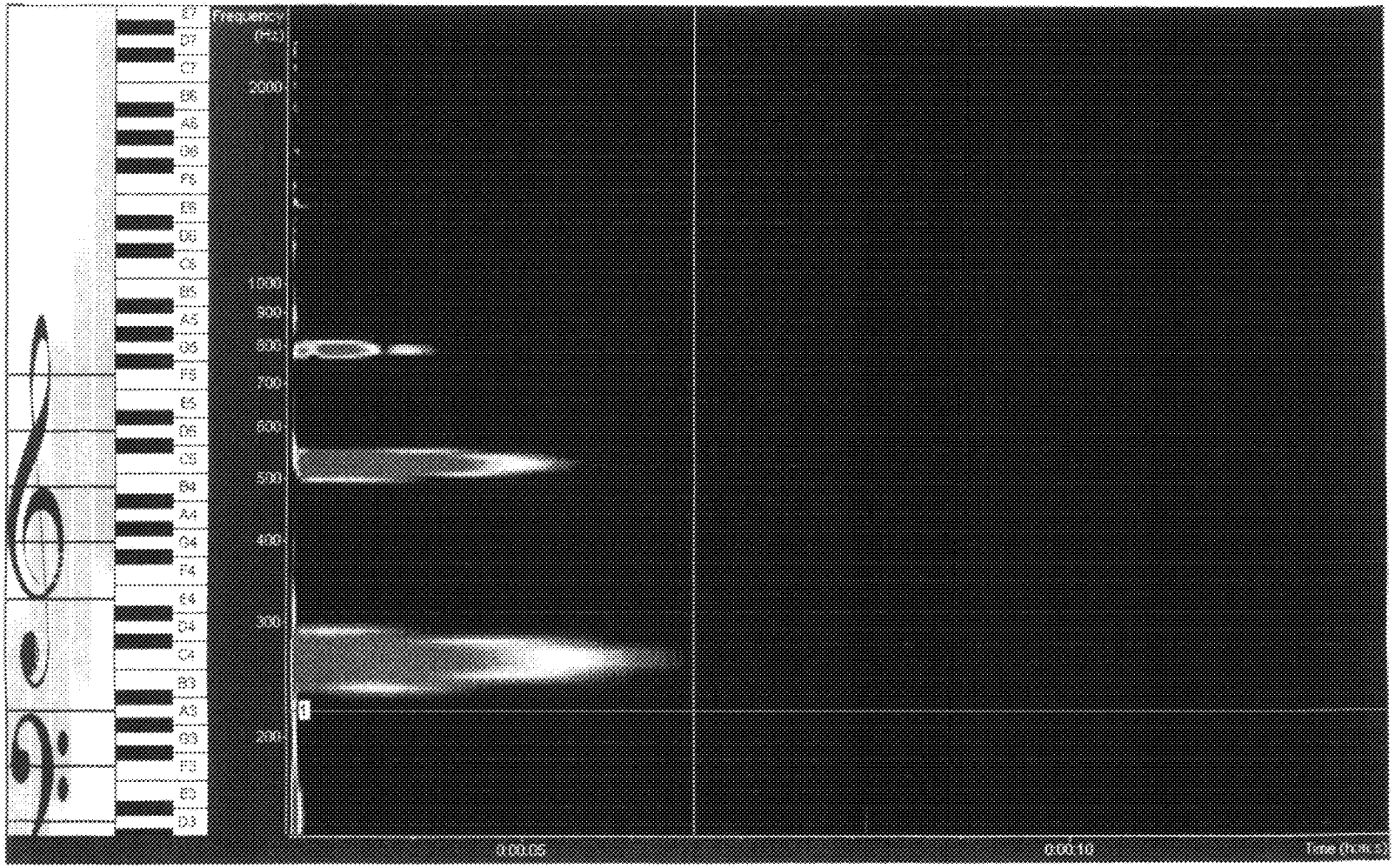
FIG. 11 is a print out showing the sound generated when the C4 tongue is played and a C4 tuned SDTF sympathetically vibrates.
Figure 12:
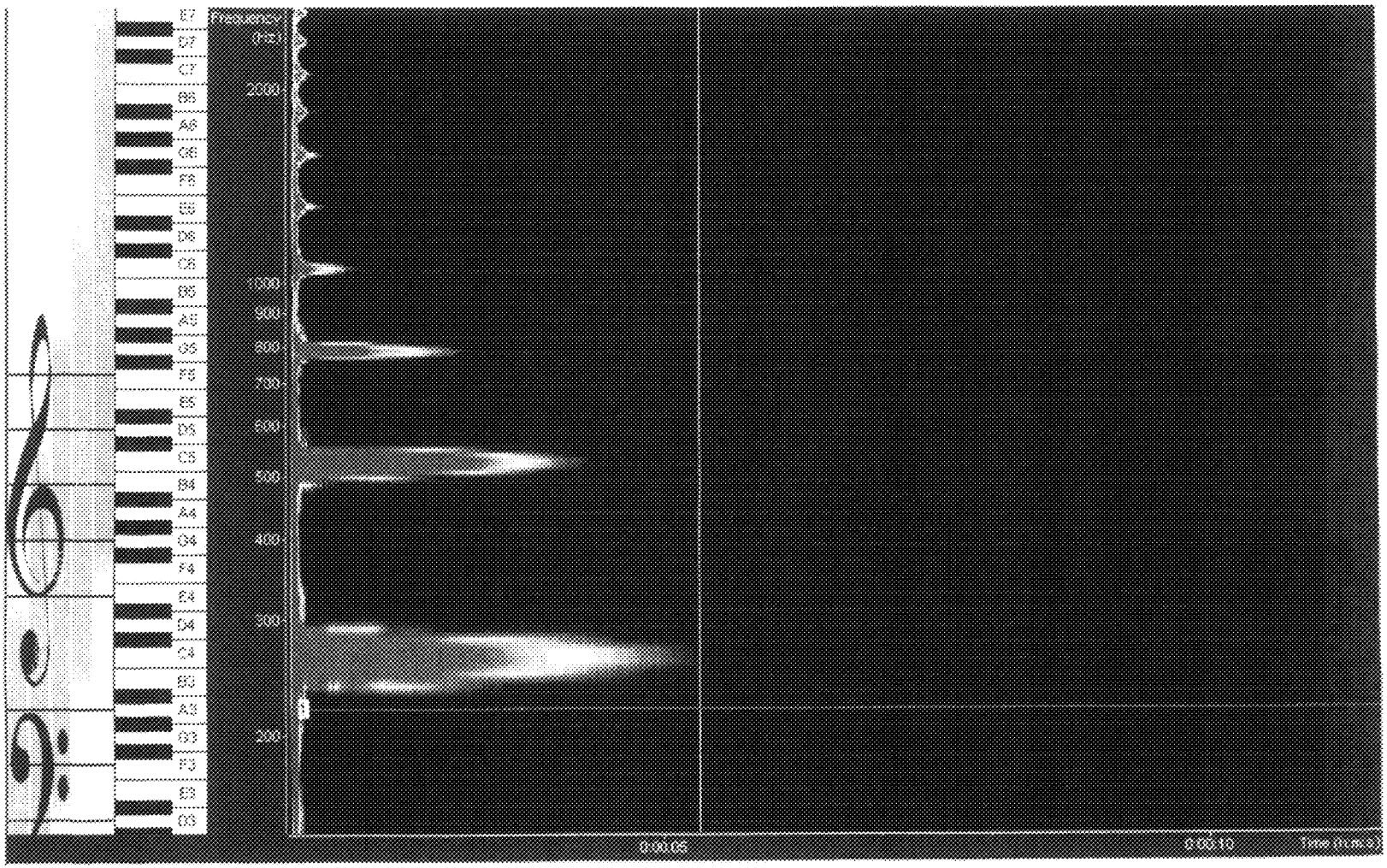
FIG. 12 is a print out showing the sound generated when the C4 SDTF is played and the C4 tongue sympathetically vibrates.

The benefits or advantages of this are as follows:

1. Longer tone duration of the SDTF with a slower rate of decay.

a. A steel tongue has a tone duration of 4 to 8 seconds (FIG. 8). An SDTF has a tone duration of approximately 3.5 seconds (FIG. 9). When either the SDTF or the tongue is struck the sympathetic interaction between SDTF and the tongue causes the shared vibrations between them to last longer than an SDTF by itself (FIGS. 10 and 11).

2. Improved harmonic tones for a steel tongue with an interactive SDTF than a steel tongue by itself.

a. A steel tongue has limited harmonic overtones when played (FIG. 8). However, an SDTF tone field has multiple overtones oriented specifically in the flattened field. Typically, there is a fundamental tone, an overtone tuned to an octave above that fundamental, and an additional overtone, typically a fifth, above that octave. This creates a more musical tone (FIG. 9). When a steel tongue is struck and its sympathetic SDTF starts to vibrate, the harmonics of the SDTF also begin to sound and the interaction improves the overall musical tone of the tongue (FIG. 10).

3. Effecting the attack of the SDTF.

a. When a tongue is struck and an SDTF begins to sympathetically resonate it does so without a harsh "attack" from the note. Normally when an SDTF is played with mallets or fingers there is a fast attack and one can hear the slap of the mallet or finger on the steel. With sympathetic note resonance created by a vibrating tongue the SDTF tone has a slow build (increase in amplitude) and no sound occurs due to the slap of a mallet or finger. This delayed sympathetic resonance creates a soothing, desirable effect.

Figure 13:
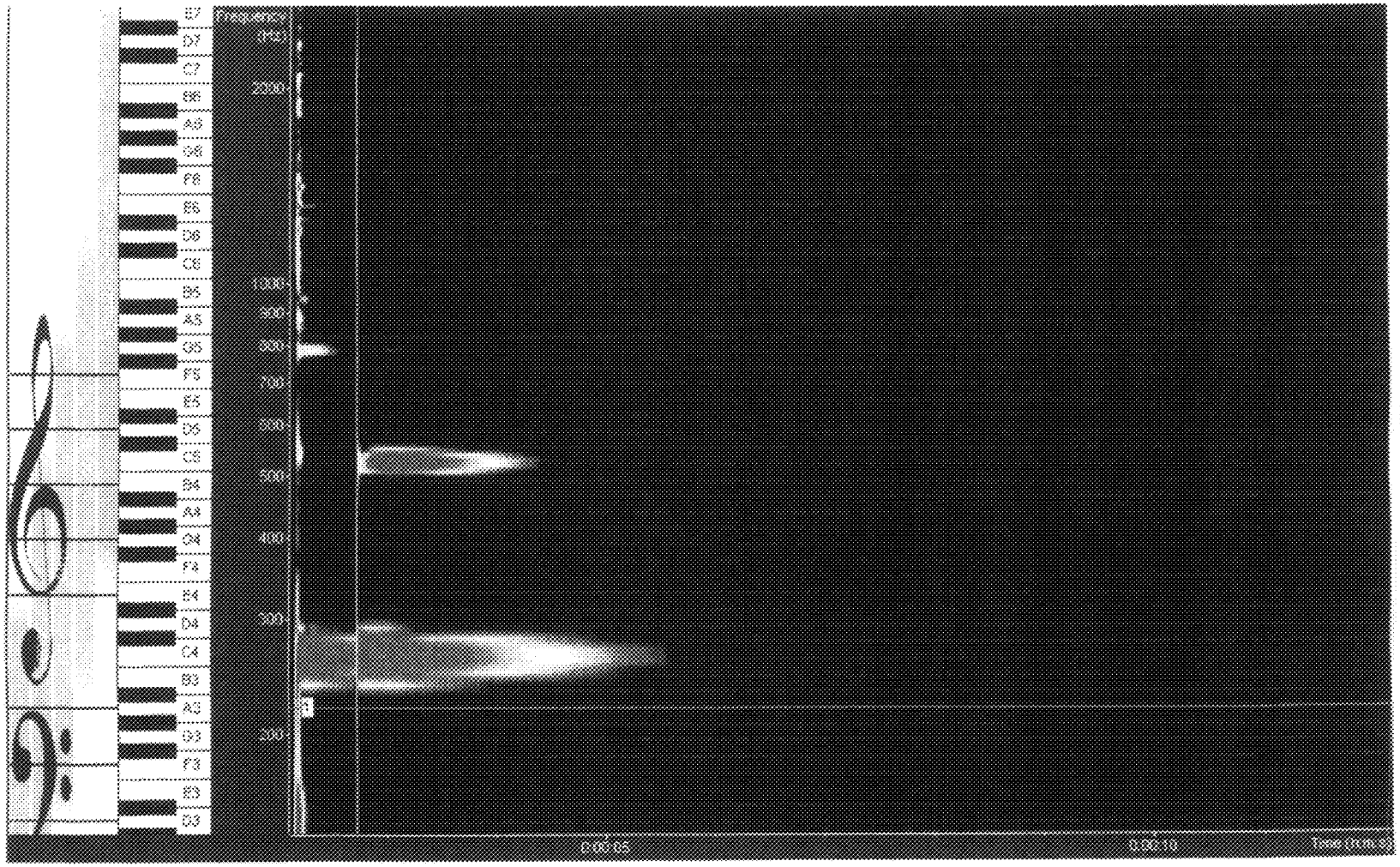
FIG. 13 is a print out of sounds generated when the C4 tongue is played while the SDTF is muted and then released after 0.6 seconds.

4. Tone manipulation.

a. By muting and then releasing either a vibrating SDTF or a tongue, one can further affect the decay and attack of the interactive tones creating different effects (FIG. 13).

The hand pan tongue drum of this invention comes in the key of F major pentatonic, however, other scales can be used such as F# minor, G major, G minor, A major, C Major and in the custom Akebono scales in the keys of F, G, A and C. Many other scales, pentatonic or not, are possible.

The hand pan tongue drum 10 of this invention can be played by placing the drum on one's lap, leaving the orifice 64 in the lower dome open for generation of sound from the interior of the drum.

While the present invention has been described in detail herein, and pictorially in the accompanying drawings, it is not limited to such details since any changes and modifications recognizable to those of ordinary skill in the art may be made to the invention without departing from the spirit and scope thereof.

What is claimed is:

1. A hand pan tongue drum comprising an upper dome and a lower dome, each of said upper dome and said lower dome having a thin sheet of metal being shaped into a bowl-like configuration with an open mouth and an apex opposite said mouth, said lower dome being inverted and attached to said upper dome such that said mouth of said upper dome is contiguous with said mouth of said lower dome, said upper dome having an upper outer surface surrounding said upper dome adjacent to said apex thereof and a lower outer surface surrounding said upper dome adjacent to said mouth, said upper dome having at least one tone field situated on said lower outer surface and at least one tongue in said upper outer surface, each of said tongues in said upper dome being individually tuned to a specific tone field separate from each other of said tongues, each of said tongues being positioned in said upper outer surface of said upper dome, said lower dome having an orifice at its apex, said orifice being of sufficient size so as to enable sounds generated by tapping on said upper dome to emanate from said drum through said orifice.

2. The drum of claim 1, wherein each of said tone fields comprises a flattened area on said lower outer surface of said upper dome and a dimple in said flattened area extending inwardly into said drum.

3. The drum of claim 1, wherein at least one of said tongues is a rectangular tongue, said rectangular tongue being defined by a U-shaped slot in said upper outer surface of said upper dome on three sides of said rectangular tongue and by being contiguous with said upper outer surface on the fourth side thereof.

4. The drum of claim 1, wherein at least one of said tongues is a semi-circular tongue that is defined by a semi-circular slot in said upper outer surface of said upper dome at said apex thereof.

5. The drum of claim 1, wherein the ratio of the diameter of said mouth of each of said upper dome and said lower dome relative to the height thereof from said mouth to said apex is about 5:1.

6. The drum of claim 1, wherein said upper dome has eight of said tone fields in spaced apart relation to each other on said lower outer surface thereof and eight of said tongues in said upper outer surface thereof.

7. The drum of claim 1, wherein said upper dome has eight of said tone fields and each of said tone fields is tuned, in sequence, to the following sounds, D in the 4th octave, F in the 4th octave, A in the 4th octave, B flat in the 4th octave, G in the 4th octave, E in the 4th octave, C in the 4th octave, and G in the 3rd octave.

8. The drum of claim 1, wherein said upper dome has eight of said tongues and each of said tongues are tuned to, sequentially, D in the 4th octave, F in the 4th octave, A in the 4th octave, B flat in the 4th octave, G in the 4th octave, E in the $4^{th}$ octave, C in the $4^{th}$ octave, and G in the $3^{rd}$ octave.

9. A hand pan tongue drum comprising an upper dome and a lower dome, each of said upper dome and said lower dome having an apex and an open mouth, said upper dome and said lower dome being inverted relative to each other and sealed tightly together to place each of said mouths in open communication with each other, said upper dome having a plurality of tone fields in a lower outer surface thereof and a plurality of tongues in an upper outer surface thereof, each of said tongues being tuned to a specific tone field separate from each other of said tongues, said lower dome having an orifice at its apex, said orifice being of sufficient size so as to enable sounds generated by tapping on said upper dome to emanate from said drum through said orifice.

10. The drum of claim 9, wherein each of said tone fields comprises a flattened area on said lower outer surface of said upper dome and a dimple in said flattened area extending inwardly into said drum.

11. The drum of claim 9, wherein at least one of said tongues is a rectangular tongue, said rectangular tongue being defined by a U-shaped slot in said upper outer surface of said upper dome on three sides of said rectangular tongue and by being contiguous with said upper outer surface on the fourth side thereof.

12. The drum of claim 9, wherein at least one of said tongues is a semi-circular tongue that is defined by a semi-circular slot in said upper outer surface of said upper dome at said apex thereof.

13. The drum of claim 9 wherein the ratio of the diameter of said mouth of each of said upper dome and said lower dome relative to the height thereof from said mouth to said apex is about 5:1.

14. The drum of claim 9, wherein the number of said tone fields in said upper outer surface of said upper dome is equal to the number of said tongues in said upper outer surface of said upper dome.

* * * * *